United States Patent [19]

Kawakami et al.

[11] Patent Number: 4,828,135

[45] Date of Patent: May 9, 1989

[54] COVER FOR A CAN-SHAPED CONTAINER

[75] Inventors: Yoshihiko Kawakami; Yoshitsugu Hamada; Takeshi Takahashi, all of Kanagawa; Junji Yotsuyanagi, Tokyo, all of Japan

[73] Assignee: Showa Denko Kabushiki Kaisha, Tokyo, Japan

[21] Appl. No.: 83,471

[22] Filed: Aug. 10, 1987

[30] Foreign Application Priority Data

| | | | |
|---|---|---|---|
| Aug. 9, 1986 | [JP] | Japan | 61-187480 |
| Aug. 22, 1986 | [JP] | Japan | 61-195507 |
| Sep. 18, 1986 | [JP] | Japan | 61-217904 |

[51] Int. Cl.[4] ..... B65D 17/34

[52] U.S. Cl. ..... 220/270; 220/265

[58] Field of Search ..... 220/265, 270, 257, 258, 220/265, 270

[56] References Cited

U.S. PATENT DOCUMENTS

| | | | |
|---|---|---|---|
| 4,267,937 | 5/1981 | Piltz et al. | 220/270 X |
| 4,428,494 | 1/1984 | Hirota et al. | 220/270 |
| 4,513,876 | 4/1985 | Buchner | 220/270 |
| 4,533,063 | 8/1985 | Buchner et al. | 220/270 |
| 4,556,152 | 12/1985 | Bogren | 220/270 X |
| 4,562,936 | 1/1986 | Deflander | 220/258 X |
| 4,693,390 | 9/1987 | Hekal | 220/270 X |
| 4,735,336 | 4/1988 | Buchner et al. | 220/270 |

*Primary Examiner*—Steven M. Pollard

*Attorney, Agent, or Firm*—Sughrue, Mion, Zinn, Macpeak, and Seas

[57] ABSTRACT

A can comprising a barrel, an upper lid and a lower lid bonded to the barrel. Both the upper and lower lids comprise a gas liquid impermeable barrier layer, preferably aluminum foil, and resin layers heat fused to both sides thereof. Another resin layer is bonded to the exterior of the lids, with the upper lids having a tab and score to be perforated by the tab built into the resin layer. According to the invention, the yield strength of the top lid is made greater than that of the lower lid to prevent breaking of the score if the can is dropped. The differential strength may be accomplished by making the barrier layer of the top lid greater than that of the bottom lid.

9 Claims, 9 Drawing Sheets

COVER FOR A CAN-SHAPED CONTAINER

BACKGROUND OF THE INVENTION

Related Inventions

This invention is related to U.S. patent application Ser. No. 032,125, filed Mar. 30, 1987.

Field of the Invention

The present invention relates generally to a cover for a can-shaped container. In particular, it relates to a cover for a can-shaped container such as a can for various drinks, canned foods, soup, motor oil, edible oils, seasonings and the like. Even more particularly, the invention relates to a cover for a can-shaped container which has improved can opening characteristics but is drop proof, particulary at high temperatures.

Background of the Invention

One such can-shaped container of the type described above uses a synthetic resin as the main material. This type has been described, for example, in Japanese Laid-Open Patent Publication No. 39489/1977. Another such cover is described in commonly assigned U.S. patent application Ser. No. 614,095, filed May 25, 1984. A similar can is disclosed by Piltz et al, in U.S. Pat. No. 4,210,618.

The present inventors previously proposed a cover as set forth below as a cover constituting such a canshaped container using a synthetic resin as the main material.

A cover for a can-shaped container is fabricated by preparing, for example, an Al (aluminum) foil having heat-fusible resin layers on both its sides to be flat without being deformed or after being preformed to remain without being substantially stretched. The so prepared Al foil and resin layers are set in advance in a mold of an injection molding machine. After that, a resin is injected to mold a cover by simultaneous injection (integral) molding.

Since the injected molten resin is laminated on the heat-fusible resin layer of the Al foil in this process, the injected resin layer has high adhesion to the Al foil and the resulting molded article is free from occurrence of release of the resin layer caused by a heat hysteresis such as occurs in retorting treatment and it also has high strength when dropped. Further, in addition to the above-mentioned advantages, the molded article has advantages that the number of manufacturing steps can be reduced and the manufacturing cost can be reduced by simultaneous injection (integral) molding.

The same cover as mentioned above can be produced by first molding a resin sheet by injection molding or the like. Then the resin sheet is laminated with an adhesive to an Al foil having heat-fusible resin layers on both its sides. The method of producing the cover by use of adhesive, however, has various disadvantages. Namely, the number of manufacturing steps increases, causing an increase in cost. Food sanitation properties of the adhesive come into question. Also, the resin layer of cover is readily released by the heat hysteresis such as a retorting treatment or the like.

The peripheral flange of the above-mentioned upper cover produced by simultaneous injection molding is fixed to the body part of the can-shaped container which has the same heat-fusible resin layer surface. The fixing utilizes a heat-fusible resin layer disposed on the Al foil on a side opposite to the laminated injected resin layer, for example, by a heat sealing process. In a panel inside a circumferential flange of the cover, there is disposed a cut between the panel and a more interior part. Within the cut, an Al foil having heat-fusible resin layers on its both sides (a multi-layer base) but not being laminated with any injected resin layers is exposed. The cut is configured like a ring with a nearly constant width of the multi-layer base being exposed to promote its tearing. The cut is so shaped to make an acute angle at a corner near a point where the opening of can starts. One end part of a grip is fixed to a pedestal comprising an injected resin layer disposed adjacent and inside the cut. Thus, the above-mentioned cover is constructed so that, by lifting the other end of the grip, the exposed multi-layer base material is pierced at a point where the cut makes an acute angle. Subsequently, the multi layer base is pulled and cut along the cut. As a result, the upper cover produced by simultaneous injection molding is opened.

Further, a lower cover produced by injection simultaneous molding and having a similar construction is fixed to the bottom of the above mentioned container.

However, the inventors have found that there are the following problems in such can-shaped containers.

Food such as a soup, a cold drink, or the like is filled into the body part of the above-mentioned canshaped container. The filled containers after being retorted are put into the food distribution chain. In a hot-pack method, contents are filled into a container while they are hot. On the other hand, in winter months, coffee or the like is heated for use at a relatively high temperature in a food sales stand or the like.

As mentioned above, the upper cover and lower cover of the can-shaped containers are produced by laminating an injected resin layer to a multi-layer base having resin layers disposed on the both sides of a thin aluminum foil. In the upper cover as mentioned above, there is disposed a notched part (cut) in which the multilayer base is exposed. Accordingly, cans are likely to leak through by pin holes pierced by the acute-angle tip of the pedestal when the can is dropped. Furthermore, at such a high temperature as mentioned above, the multilayer base exposed by the cut of the upper cover is apt to undergo a deformation or be damaged, in particular, at the acute angle at its tip. In addition to the above, the inventors have found that by the above-mentioned deformation of the multi-layer base in the cut, can strength when a can is dropped is lowered. Further, due to deformation or elongation of the base material in the cut playing a big role when the cover is opened, the cover becomes hard to open or a jagged film remains adhering to an opening, lowering substantially the opening properties of the cover and the product value of the container.

SUMMARY OF THE INVENTION

An object of the invention is to provide a cover for a can-shaped container, which cover is a synthetic resin cover using a synthetic resin as the main material and which is able to be opened without use of an auxiliary tool such as a can-opener.

A further object is to provide a cover having high strength when the container is dropped and also having excellent opening properties, that is, combining two characteristics contrary to each other.

At the same time, it is a yet further object to provide a can having such a cover which can pass the standard of product strength when dropped, as prescribed in the legal standard (notification No. 20 of the Japanese Ministry of Health and Welfare) which has been a big obstruction when containers having such a synthetic resin cover have so far been commercialized.

Other objects and beneficial characteristics of the invention will be clarified by the entire description of the specification and by attached drawings.

The inventors have studied the mechanism of opening the cover of can-shaped containers. Such a cover comprises an upper cover prepared by laminating by injection molding a resin layer to a multi-layer base having heat-fusible resin layers on both the sides of a metallic foil. Further, a cut in the laminated resin layer for opening the cover is disposed within a panel of the laminated resin layer. The cut has the above-mentioned multi-layer base exposed within it. A lower cover is prepared by laminating by injection molding a resin layer to a multi-layer base having heat-fusible resin layers on the both sides of a metallic foil. A body part is fixed to the lower cover and to the upper cover. As a result, they have found that the conventional cover generally considered to have had good opening properties and have a cut making an acute angle at a corner near a point where the can opening starts can be improved. The improved cover does not have a cut forming an acute angle, but instead the cut is entirely formed in a continuous curved shape (such as a circle or ellipse). This improved cover is very easy to open and produces a very small amount of residual film caused by elongation of the multilayer base material upon opening of the multi-layer base in the cut area.

The reason for what has been mentioned above is as follows. When a multi-layer base containing a resin layer that easily yields is pierced with a shape projection, stress is locally concentrated. Therefore, if the metallic foil away from the projection is torn with a low stress, the resin layer is apt not to be cut but to yield or deform. Contrary to this, when the grip is lifted to apply a stress to an opening point in a cut of a form having no acute projected parts, the opening part in a linear form distributes the stress and can accumulate a larger stress over the entire area. Therefore, at the same time the metallic foil is cut, the multi-layer film layer is cut before it yields.

It has been confirmed that, with the cover thus devised, leakage caused by pin holes produced by the acute point when the can is dropped does not occur and the cover has substantially improved strength when the container is dropped.

It has been also confirmed that, if the fracture strength of the metallic foil is preferably larger than that of resin layers constituting the multi layer base, the cover can accumulate a larger stress (or larger energy) at a stable state so that a smoother opening performance can be obtained. This last feature is the focus of the present application.

Thus, a plastic cover for a can-shaped container which cover has high breaking strength and also excellent opening properties, a combination of two physical properties contrary to each other, has been obtained although it had been considered difficult at the beginning to produce such a cover.

DETAILED DESCRIPTION OF THE EMBODIMENTS

The invention will be described referring to embodiments as shown in drawings hereinafter.

Figure 1:
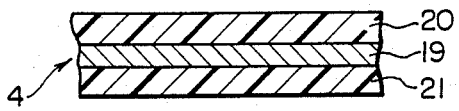
FIG. 1 shows the cross sectional view of a multi-layer base in an upper cover showing one example of the invention.

FIG. 1 shows one example of a cross section of a multi-layer base 4 of an upper cover used in the invention. The multi-layer base 4 has a heat fusible, adhereable resin layer 20 on one side of a metallic (Al) foil 19 and also another heat-fusible, adhereable resin layer 21 on the other side of the foil 19.

Figure 2A:
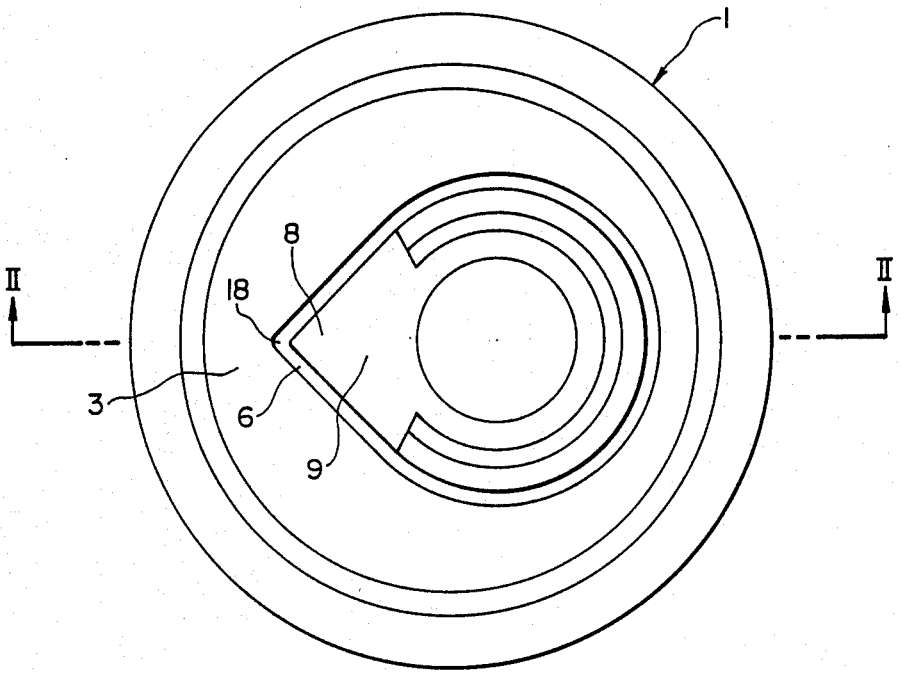
FIG. 2A shows a conventional configuration of the opening in an upper cover and FIG. 2B shows the sectional view of a line II—II in FIG. 2A.

FIG. 2A is a plan view of a conventional cover 1 having a point 8 where can opening starts. The cover 1 is constructed so that stress tends to be concentrated and pin holes are apt to be formed in a tip 18 of a cut 6 in a material overlaying the multi-layer base 4. The cut 6 is close to the point 8.

Figure 2B:
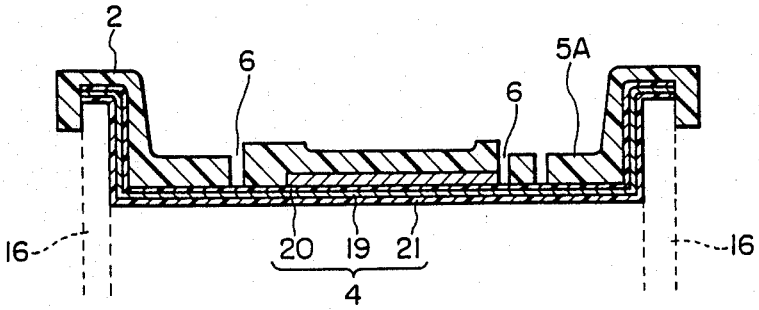

FIG. 2B shows the sectional view along a line II—II in FIG. 2A.

Figure 3:
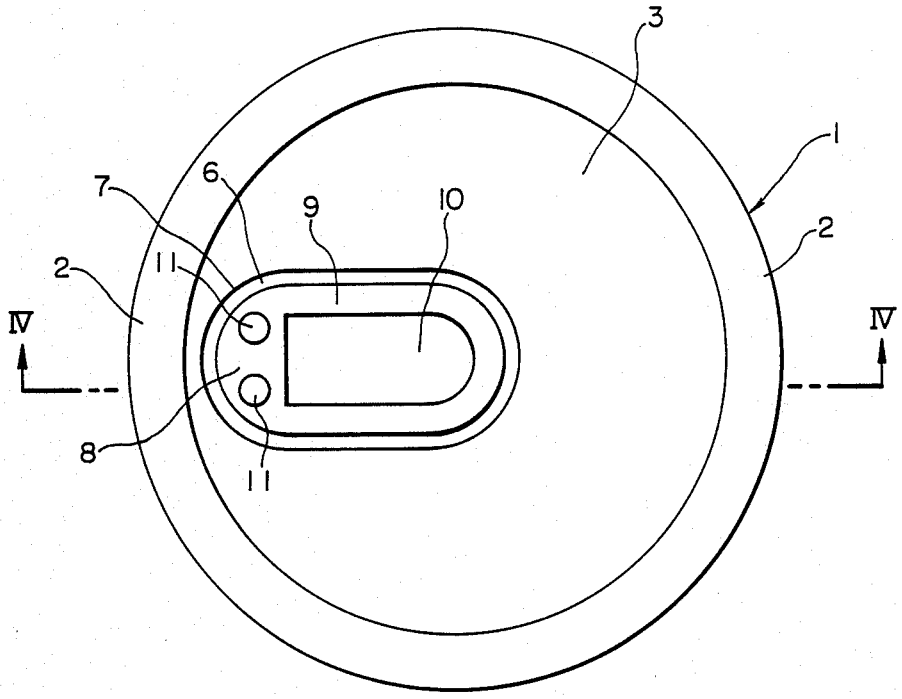
FIG. 3 is the plan view of the main body of a partially assembled upper cover showing one example of the invention.
Figure 4:
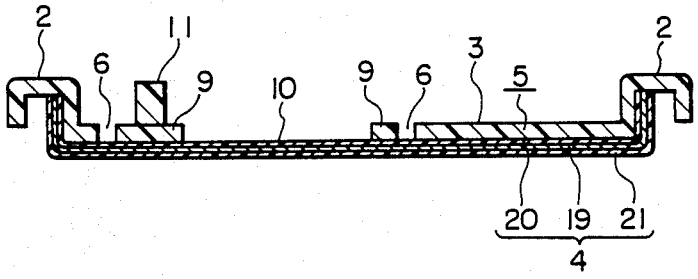
FIG. 4 is the sectional view along the line IV—IV in FIG. 3.

FIG. 3 shows a plan view of one example of the main body of an upper cover produced according to the invention and before being furnished with a grip. FIG. 4 shows a sectional view of line IV—IV in FIG. 3.

The main body 1 of the above-mentioned upper cover comprises its peripheral flange 2 and its inside panel 3. This structure is duplicated in a lower cover 17, shown in FIG. 9.

The main body 1 of the upper cover is produced by laminating an injected resin layer 5 to the multi-layer base 4. However, in a panel 3, there is disposed a cut (notched part or score) 6 in which the injected resin layer 5 is not laminated and in which the multi-layer base 4 is exposed. The cut 6 is smoothly shaped with continuous lines and curves, as shown in FIG. 3. FIG. 3 shows one specific example having a cut 6 formed in an elliptical shape. In particular, the surface is smooth and there is no sharp point for initiating opening. One definition of smooth is that any corner consists of a curved surface visible to the unaided eye, or, alternatively, it lacks a visible acute angle. It is preferable that the smoothly shaped portion of the cut 6 be defined by a circle having a radius of 0.5 mm or more, more preferably of 2.0 mm.

The cut 6 is of generally constant width. Takahashi et al in U.S. Pat. No. 4,155,481 show a smooth cover opening tab.

As described later, the opening of the cover 2 is carried out by tearing the multi-layer base along a peripheral edge 7 of the belt-shaped cut 6.

A semi-circular pedestal 8 is disposed on the inside of the cut 6, on the left side as shown in FIG. 3. Further, an extension 9 having a shape of a side facing U extends from the pedestal 8. The pedestal 8 and extension 9 are formed together with the panel 3 from the injected resin layer 5. The tip of the pedestal 8 away from the extension 9 is used to press through the multi-layer base 4 so as to initiate tearing.

An aperture 10 surrounded by the extension 9 and the pedestal 8 has a shape of a rectangle with one curved side. The multi-layer base 4 is exposed through the aperture 10, as well as through the above-mentioned cut 6.

The aperture 10 exposes the multi-layer base 4 in the above-mentioned example, but, if desired, the injected resin layer 5 may be laminated within the aperture 10 while remaining separated from the panel 3 by the cut 6.

Bosses 11 are disposed on the pedestal 8. Two bosses 11 are disposed in the example as shown in FIG. 3, but there may be only one boss 11. The bosses 11 provide attachment for a grip to the pedestal 8.

Figure 5:
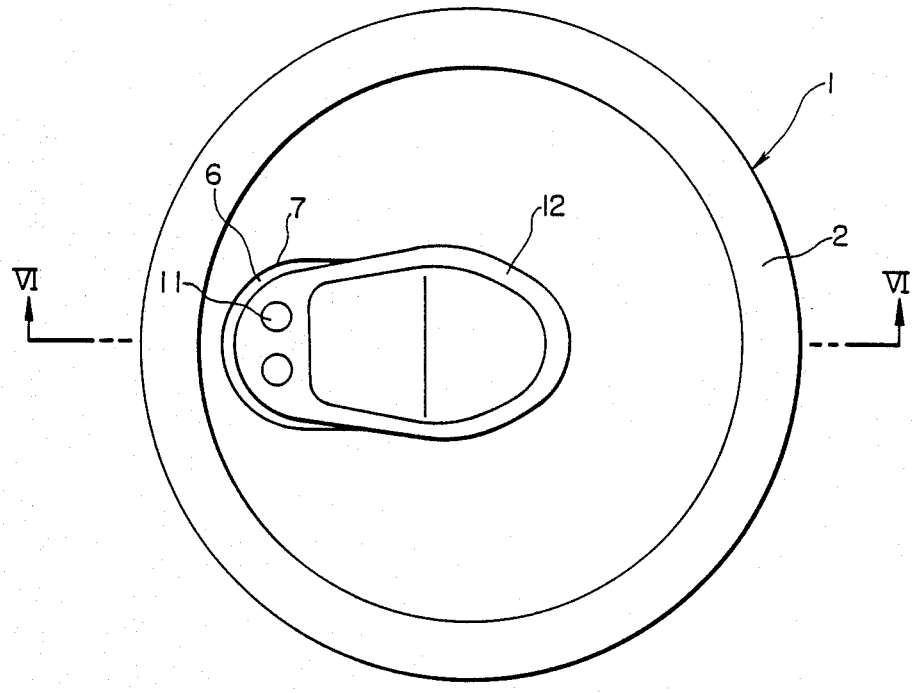
FIG. 5 is the plan view of upper cover showing one example of the invention.
Figure 6:
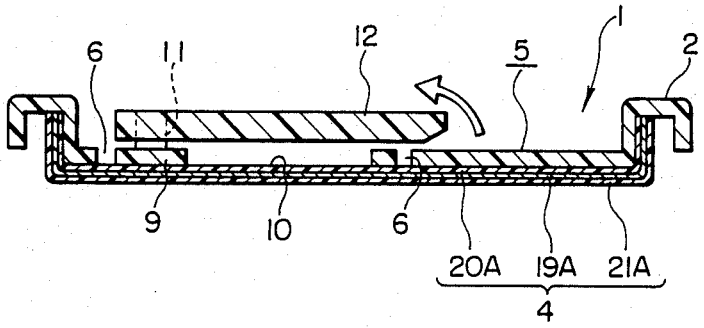
FIG. 6 is the sectional view of a line VI—VI in FIG. 5.

FIG. 5 shows the plan view of one example of an upper cover 13 having a grip 12 fixed to the main body 1 of the upper cover as shown in FIG. 3. FIG. 6 shows the sectional view of line VI—VI in FIG. 5.

A grip 12 can be fixed to the boss 11, for example, by the following method. The same number of round holes as that of the bosses 11 are bored in the left tip of the grip 12. Then, the head of each boss 11 is projected through the corresponding round hole. After that, the projected head is melted by ultrasonic welding to fill the hole with the melt. The grip 12 is made of a resin and, as mentioned above, it is fixed to the main body 1 of the upper cover by the bosses 11.

Figure 7:
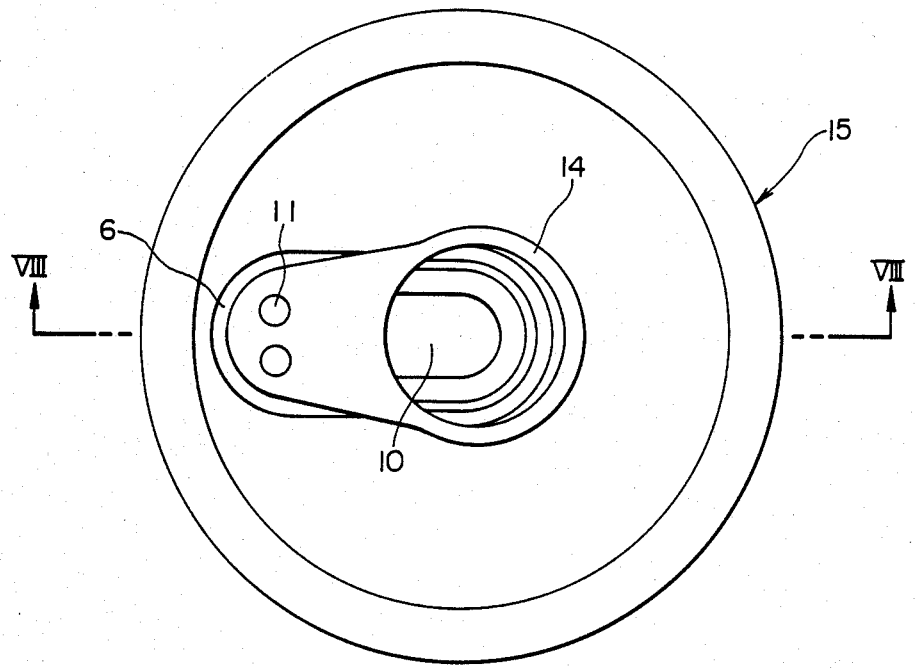
FIG. 7 is the plan view of the upper cover showing another example of the invention.
Figure 8:
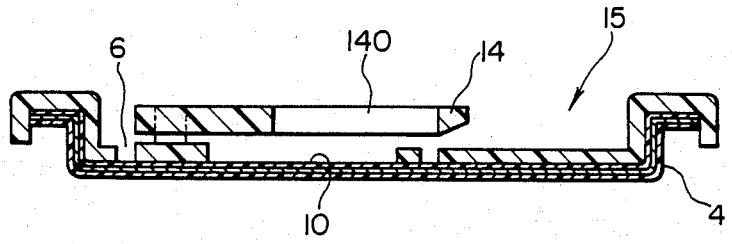
FIG. 8 is the sectional view of a line VIII—VIII in FIG. 7.
Figure 9:
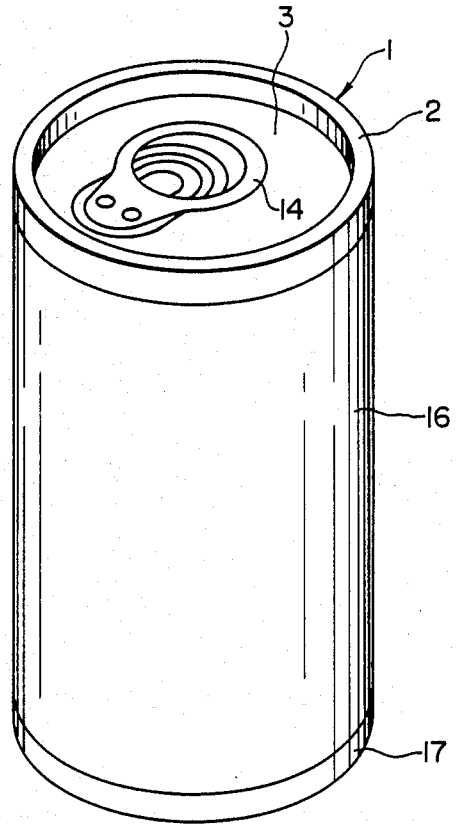
FIG. 9 is the perspective view of a can-shaped container showing one example of the invention.

FIG. 7 shows the plan view of an upper cover 1 produced by fixing a grip 14 different from that in FIG. 5 to the main body 1 of the upper cover as in FIG. 3. A round hole 140 is formed in the grip 14 so that the multi-layer base 4 can be pierced with a straw through the hole 140 to allow sucking of the contents of the can through the straw without otherwise opening the can. FIG. 8 shows the sectional view of line VIII—VIII in FIG. 7. FIG. 9 shows the perspective view of one example of the can-shaped container constructed by fixing the upper cover 1, as shown in FIG. 7, to a body 16 of the can-shaped container with the flange 2 of the upper cover 1. Further, a lower cover 17 is fixed to the bottom part of the body 16. The construction of the lower cover 17 is similar to that of the upper cover 1 but the panel 3 is continuous and completely covers the multi-layer base 4. However, some important differences between the upper and lower covers 1 and 17 will be described later.

Figure 10:
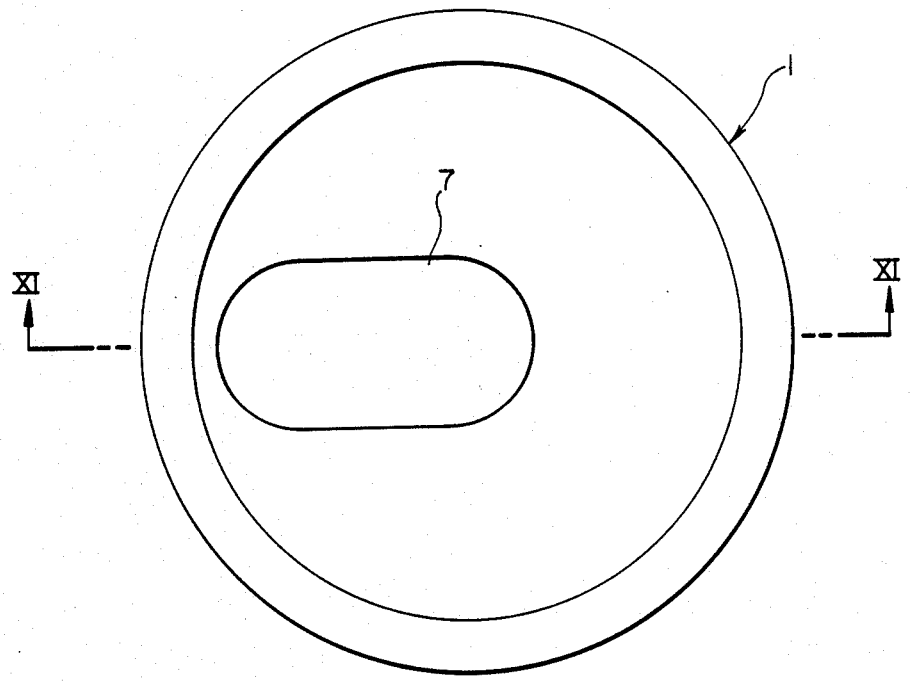
FIG. 10 is the plan view of an upper cover showing one example of the invention after being opened.
Figure 11:
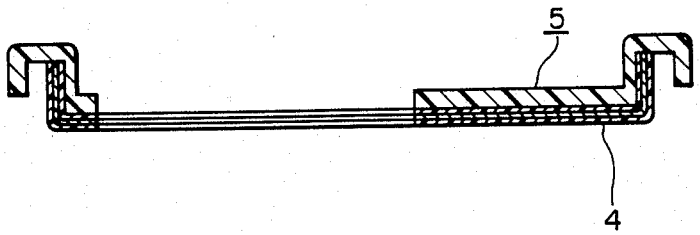
FIG. 11 is a cross-sectional view taken along the line XI—XI of FIG. 10.

Further, FIG. 10 shows the plan view of an upper cover 1 after it has been opened. FIG. 11 shows the sectional view along the line X—X in FIG. 10. Opening of the upper cover 1 is described referring to FIG. 6 and it occurs as follows. When the rear end part of the grip 12 is lifted in the direction shown by a curved arrow in FIG. 6, the multi-layer base 4 is pierced by the tip of the pedestal 8. Further, when the grip 12 continues to be pulled, opening of the upper cover 1 is achieved as the multi-layer base 4 is torn along the peripheral edge 7 of the cut 6.

An alternative, unillustrated shape for the upper cover is one in which the cut 6 is circular. In this case, the pedestal 8 and its extension 9 can be combined into a circular band or annulus slightly larger in width than the cut 6. Then, the grip 14 can fit within the annulus in the unopened state of the can.

The grip 14 may be formed with a transverse crease or recess on its upper side to facilitate manual pulling of the extension 9. Similarly, there may be a crease between the pedestal 8 and its extension 9 to promote the penetration of the tip of the pedestal 8 into the multi-layer base 4.

The upper cover 1 of the invention can provide an upper cover having excellent opening properties because the panel 3 of the upper cover 1 is divided by the cut 6 into a part to be opened and an unopenable part. The cut 6 is formed in a curved shape such as an elliptical shape or the like having appropriate width. One end of the cut 6 is disposed at a position as near the flange 2 of the upper cover 1 as possible. The grip 12 is firmly fixed to bosses 11 on the pedestal 8 by ultrasonic welding.

An explanation will now be made as to the material of the multi layer base 4.

The multi-layer base 4 is composed of the barrier layer 19 and the synthetic resin layers 20 and 21 which are adhered to both surfaces of the multi-layer base 4. The gas-barrier layer 19 may be composed of aluminum foil, sheet, or film. A typical metal foil is an aluminum foil. However, the material for the barrier layer 19 may be selected from the group of saponified products of ethylene vinyl acetate copolymer, poly (vinylidene chloride), polyamide, polyacrylonitril, etc.

The multi-layer base 4 is coated over at least one side surface with resin (which will be referred to as a first resin layer). If the yield strength of the first resin layer would be smaller than that of the aluminum foil the aluminum foil would first be opened and the openability of the score portion 6 would be degraded due to a possible elongation of the resin during the opening.

Figure 11A:
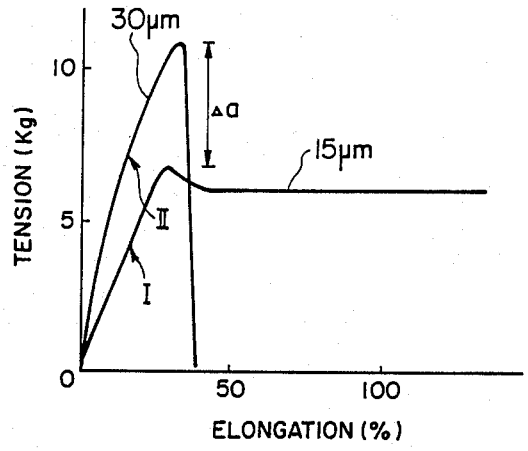
FIG. 11A is a graph of the yield and fracture characteristics of two upper covers with different aluminum foil thicknesses.

The multi-layer base 4 having a relatively thick aluminum foil is superior in openability to that having a thin aluminum foil. The result of the multi-layer bases having the aluminum foil with thicknesses of 15 micrometers and 30 micrometers, as indicated below in Table 1, is shown in FIG. 11A and tabulated in Table 2.

TABLE 1

| multi-layer base | resin (inner) | aluminum foil | resin (outer) |
|---|---|---|---|
| I | 70 μm | 15 μm | 70 μm |
| II | 70 μm | 30 μm | 50 μm |

TABLE 2

| Barrier Layer | Openability 23° C. | Openability 60° C. |
|---|---|---|
| I (Al 15 μm) | Δ | X |
| II (Al 30 μm) | O | O |

O . . . good
Δ . . . poor
X . . . impossible

The tension property of the multi-layer base 4 will now be described with reference to FIG. 11A. In the multi layer base I with the thin aluminum foil, since the yield strength of the aluminum foil is small, even if the aluminum is severed, the resin is not cut but only elongated.

In the base II (the thickness of the aluminum foil is increased to 30 micrometers), since the yield strength of the aluminum foil is much higher than that of both the resin layers, the resin is also cut by the cutting shock of the aluminum foil simultaneously with the fracture of the aluminum foil. Thus, in this case, the elongation of the resin layers is small.

Can opening test were conducted by using the above-described multi layer bases. With respect to the base I, the base was elongated upon the opening, resulting in opening failure. In particular, under the high temperature condition, the base I could not be used due the elongation of the resin. In this case, such a can could not be practically used.

In the base II, there was no elongation during the opening, and its opening property was kept in a good condition even at a high temperature.

The thickness of the metallic foil 19 of the above-mentioned upper cover is preferably 9 micrometers or more, more preferably 9–60 micrometers. Even more preferably, the thickness of the foil 19 is 15–38 micrometers.

Further, it is preferred that the resin layer 20 or 21 is laminated under the condition that the fracture strength of the resin is less than that of the Al foil. This condition on fracture strength can be satisfied if the metallic foil 19 is more rigid than the resin layers 20 and 21 so that the major portion of any stress in the multi-layer base 4 is borne by the metallic foil 19. Therefore, when the metallic foil 19 is fractured by the stress in tearing, the resin layers 20 and 21 are unable to assume the extra stress and they too immediately break with a clean edge. Therefore, the preferred thickness of the resin layer 20 or 21 in such a case is 100 micrometers or less on each side of Al foil. More preferably, the thickness of either the upper or lower resin layer 20 or 21 is in the range of 30–80 micrometers. Even more preferable is a range of 30–50 micrometers.

Figure 1A:
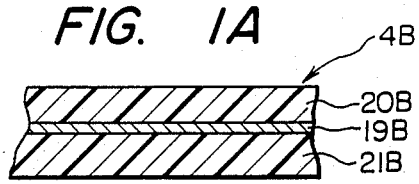
FIG. 1A shows the corresponding cross sectional view of a multi-layer base in a lower cover.
Figure 11B:
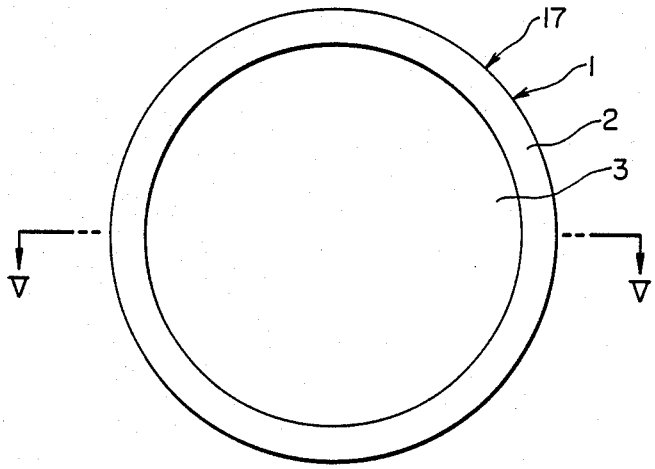
FIGS. 11B and 11C are plan and sectional views respectively of a lower cover of the invention.
Figure 11C:
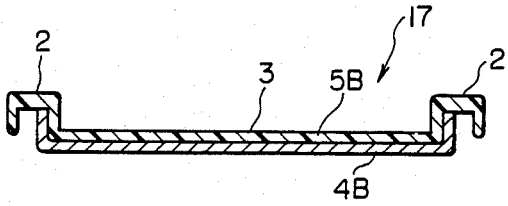

On the other hand, a multi-layer base 4B, shown in FIG. 1A for the bottom of the can-shaped container has a resin layer 20B made of resin that is adhered with a melt-adhesive over one surface of a metal foil 19B as shown in FIG. 11C. Also, the multi-layer base 4B has on the other surface a resin layer 21B that is melt-adhesive bonded.

While the thickness of the overall upper lid 4 is the same as that of the bottom 4B, a thickness of the metal foil 19 of the upper lid 4 is greater than that of the metal foil 19B of the bottom or lower lid 4B.

FIG. 11B is a plan view showing a lower lid or bottom according to the present invention. The bottom lid 17 is composed of a peripheral flap portion 2 and an inside panel portion 3. FIG. 11C is a cross-section taken along the line V—V of FIG. 11B. As shown in FIG. 11C, an injected resin layer 5B is laminated on one side of the multi-layer base 4B. The flap portion 2 is constructed so that it may be attached to a barrel portion of the can-shaped container. The heat-bondible resin layer 21B of the multi-layer base 4B is heated to be molten so that the bottom 17 may be attached to the barrel portion 16 as shown in FIG. 9. In this heating and bonding process, it is preferable to use a high frequency bonding technique.

As explained in conjunction with FIGS. 1 and 1A, the thickness of the metal foil of the upper lid is greater than the thickness of the metal foil of the lower lid. The lower lid or bottom 17 mainly serves to be subjected to a deformation in the high temperature condition such as a retort or hot packaging to thereby reduce a stress to be applied to a score portion 6 of the upper lid. Thus, a deformation of the score portion 6 is suppressed, which leads to an improvement in the drop proof property of the container. It is preferable that the thickness of the metal foil 19B be in the range of 5 to 20 micrometers.

In the preceding embodiment, the elasticity of the upper lid was made greater than that of the bottom by changing the thickness of the metallic foils 19 and 19B. However, other techniques are available, as follows.

The kinds of the injected resin layers for the respectively upper and lower lids may be different. For example, the resin of the upper lid may be made of polypropylene block copolymer and the resin of the lower lid is made of polypropylene random copolymer.

Alternatively, the kinds of the material of the barrier layers 19 and 19B in the multi-layer bases for the upper and lower lids may be different. For example, the barrier layer material of the upper lid may be made of aluminum foil and the barrier base material of the lower lid may be made of resin film.

According to the present invention, the elasticity refers to a constant relationship between a stress and strain within the elasticity limit, and includes a Young modulus or displacement elasticity.

The metallic foil 19 is used with the aim of incorporating properties of a metallic can to prevent oxygen, water, and the like from permeating therethrough, that is, the so-called gas barrier properties. It is preferred that the metallic foil is an aluminum foil.

The multi-layer base 4 of the invention can be completely incinerated if the thickness of the multi-layer base 4, in particular, of the metallic foil 20 for example, Al foil, is appropriately selected. In recent years, the problems on treating empty cans have been discussed. However, it has become possible to completely incinerate the can of the invention by selecting the thickness of the Al foil and the material of the resin layers 20 and 21 of the multi-layer base 4 so that the problem of treating empty cans can be dealt with successfully. As the heat of combustion with the can of the invention can be reduced to 5000–6000 kcal/kg, the problem of disposing of empty cans can be solved completely.

The multi-layer base 4 used in the invention for the upper or lower lid may be produced by laminating heat fusible resin layers 20 and 21 to both the sides of the above-mentioned gas barrier base material (metallic foil) 19.

The outer layer 20 of the above-mentioned resin layers is thermally fused with the injected resin layer 5 to form a cover having high adhesion between the resin layer 20 and the Al foil 19. On the other hand, the inner resin layer 21 is thermally fused with a resin layer of the body 16 to firmly fix the cover to the body.

As the constituent resin of the above-mentioned resin layers 20 and 21, a heat fusible resin, such as a thermoplastic synthetic resin, is used. Such a resin layer can be laminated to the metallic foil 19 with an adhesive or a film-shaped hot melt adhesive, or can be directly laminated without using such an adhesive.

The upper cover for a can-shaped container of the invention can be produced, for example, by the following process.

Figure 12:
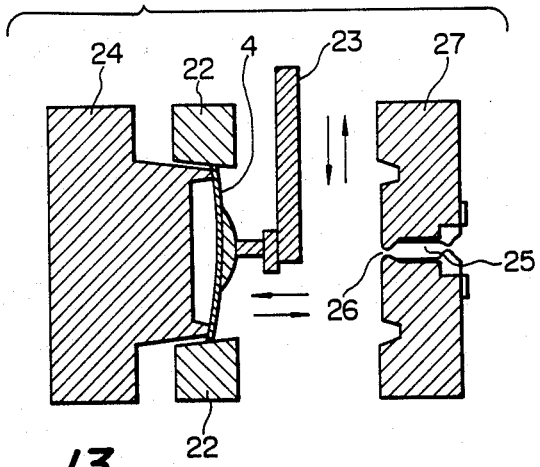
FIGS. 12–14 are each a sectional view for describing a cover molding process.
Figure 13:
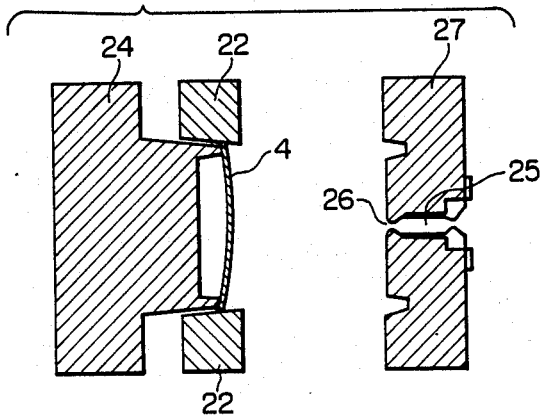
Figure 14:
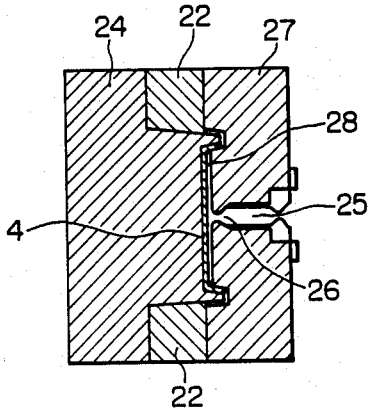

The process will be described referring to FIG. 12 to FIG. 14. As shown in FIG. 12, a multi-layer base 4 is inserted into a guide member (stripper plate) 22. The insertion can be performed while the multi-layer base 4 is suctioned on a robot transfer cylinder 23. As shown in FIG. 13, the multi-layer base 4 is fixed in the stripper plate 22 to prevent it from getting out of position. After that, the multi-layer base 4 is clamped to core type mold 24 by a cavity type mold 27, as shown in FIG. 14. By the clamping, the edge part of the multi-layer base 4 in the shape of a flat plate two dimensional shape) is bent on the mold (core type, reception type) 24. After that, a molten resin is injected through a gate 26 of the mold (cavity type, injection type) 21. The cavity mold 26 has a resin inlet passageway 25 and the gate 26 leading into a cavity (a space within a mold) formed by both the core mold 24 and the cavity mold 27. Thus, the second resin layer 5 is formed from the above-mentioned molten resin and is laminated to the surface of one side of the multi-layer base 4. The cavity mold 27 is so designed as to define together with the resin layer 5 the pedestal 8 with its bosses 11, the extension 9 connected to the pedestal 8 and the surrounding panel 3 and flange 2. Thus, the main body 1 of the upper cover is obtained.

By injection of the resin layer 5 onto the multi layer base 4, as mentioned above, the main body 1 of the upper cover can be obtained. The main body 1 has the flange 2 and the panel 3, the pedestal 8 with bosses 11 disposed on the pedestal 8 and the extension 9 form the pedestal 8, all of which are composed of the injected resin layer 5 and are integrally molded. Furthermore, a notch 6 or cut 6 is formed at the same time the injection molding is carried out. The cut 6 exists between the panel 3 and the other interior parts.

The grip 12 is prepared with the same resin by a process different from the above-mentioned injection molding and it is fixed to the boss 11 by ultrasonic welding.

The main body 1 of the upper cover for a can-shaped container of the invention can be obtained by the above-mentioned process. However, as a result of the subsequent studies on the injection molded cover of the invention, it has been found that better results can be obtained by a process as set forth below. The improved process will be described with reference to FIG. 15 and FIG. 16.

Figure 15:
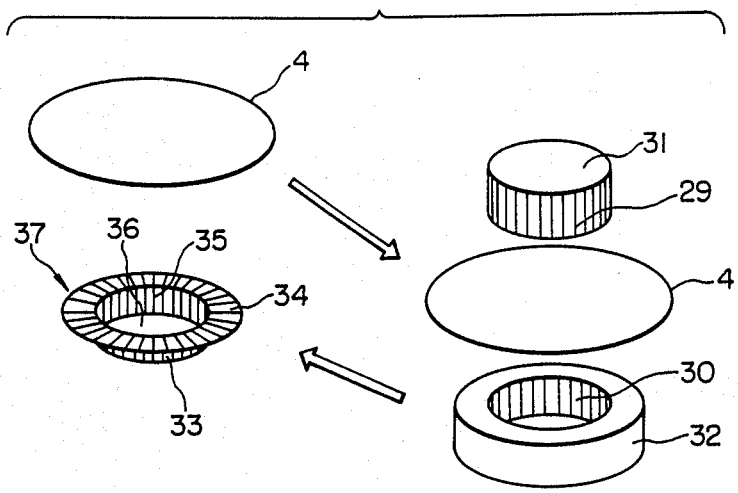
FIG. 15 is a diagram for another cover molding processes.
Figure 16:
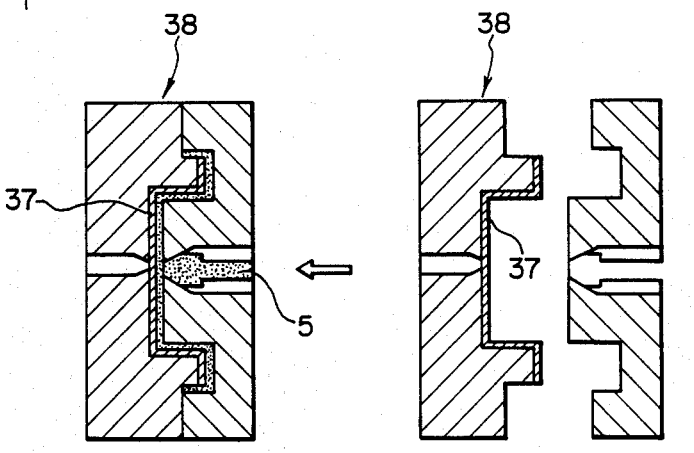
FIG. 16 is sectional views for describing the cover molding process in conjunction with FIG. 15.

As shown in FIG. 15, a disk-shaped multi-layer base 4 is set between a male mold 31 and a female mold 32. The male mold 31 actually has a flange-shaped plane plate disposed on the top of it, the plane plate not being illustrated. The male and female molds 31 and 32 have engraved longitudinal grooves 29 and 30, respectively. Then, the male mold 31 is inserted into a hollow part of the female mold 32. Thus, the surplus part of the multi-layer base 4 is absorbed as wrinkles 33 in a longitudinal direction. There is thus obtained a container-shaped, preformed multi-layer base 37 having a flange 34, a body wall 35, and a bottom 36 under the condition that the multi-layer base 4 is not substantially stretched.

The preformed multi-layer base 37 is set in an injection molding mold 38 and a resin 5 for injection molding is injected onto the base 37.

In the injection molding, the multi-layer base 37 is pressed to the mold 38 by resin pressure in an injection molding machine and as a result, the wrinkles 33 are smoothed.

Thereby, the new process has the following various advantages.

Although irregular large wrinkles are formed on the multi-layer base 4 in the flat insert molding process as shown in FIG. 12–FIG. 14, it is possible to prevent such irregular large wrinkles from formation in the improved process. When the flange 2 of the cover 1 for a can-shaped container having a flange consisting of the second resin layer is fused to the body 16 of the can-shaped container by ultrasonic induction heating, it is possible to prevent bad appearance from arising. Also, it is possible to prevent the gas barrier base material 19 of the multi-layer base 4 from breaking caused by local heating. Further, as the multi-layer base 4 is preformed substantially without being stretched, a thin Al foil can be used. Also, the Al foil in the obtained molded article can have uniform thickness.

As the above-mentioned injected resin 5 used in the invention, various resins can be used but as the preferred one, there may be mentioned poly olefin-containing synthetic resins such as polypropylene, ethylene-propylene copolymers, and the like which have excellent heat resistance for a high temperature, for example, when the can-shaped container is retorted. Inorganic fillers may be mixed with these resins. By mixing of inorganic fillers, the following advantages can be obtained.

(1) The dimensional stability of can-shaped containers is improved and the shrinkage factor is reduced.

(2) The heat resistance of the containers is improved and the thermal deformation temperature is raised which is advantageous for retorting of the containers.

(3) The heat of combustion is reduced and a combustion furnace is not damaged when the container is incinerated within it, which is advantageous in respect of prevention of environmental pollution.

(4) The rigidity is increased, which is advantageous when the containers are distributed as goods.

(5) The heat conduction is improved, which is advantageous in respect of retorting of the containers.

(6) The cost can be reduced.

As the inorganic fillers, the ones used generally and widely in the field of synthetic resins and of rubbers may be used. As the inorganic fillers, the ones having good food sanitation properties and which do not react with oxygen and with water and are not decomposed when mixed with the resin or when the mixture with the resin is molded are preferably used. The above-mentioned inorganic fillers are broadly divided into compounds such as metallic oxides, hydrates (hydroxides), sulfates, carbonates, and silicates, double salts of these compounds, and mixtures of these compounds. As the representative example of the inorganic fillers, there may be mentioned aluminum oxide (alumina), its hydrate, calcium hydroxide, magnesium oxide (magnesia), magnesium hydroxide, zinc oxide (zinc white), lead oxides such as minium and white lead, magnesium carbonate, calcium carbonate, basic magnesium carbonate, white carbon, asbestos, mica, talc, glass fiber, glass powder, glass beads, clay, kieselguhr, silica, warringtonite, iron oxide, antimony oxide, titanium oxide (titania), lithopone, pumice powder, aluminum sulfate (gypsum or the like), zirconium silicate, zirconium oxide, barium carbonate, dolomite, molybdenum disulfide, and iron sand. Of powdered types of these inorganic fillers, the ones having a particle diameter of 20 micrometers or less (suitably 10 micrometers or less) are preferred. As fibrous types of fillers, the ones having a fiber diameter of 1–500 micrometers (suitably 1–300 micrometers) and fiber length of 0.1–6 mm (suitably 0.1–5 mm) are preferred. Further, as plate-shaped types of fillers, the ones having a plate diameter of 30 micrometers or less (suitably 10 micrometers or less) are preferred. Of these inorganic fillers, plate-shaped (flaky) ones and powdered ones are, in particular, suitable.

Various additives such as pigments and the like may be added to a resin for injection molding.

Effect of the Invention (1) According to the invention, the inventors have succeeded in obtaining a cover for a can-shaped container. This cover has various excellent characteristics such as high strength when the container is dropped, excellent opening properties, excellent retorting characteristics and food sanitation properties, good moldability, can be incinerated completely, and has a low cost.

(2) According to the invention, a cover for a can-shaped container made of synthetic resin is produced. This cover has not only further improved strength when the container is dropped but also good opening characteristics have been obtained by disposing a cut in a rigid outer layer having a smooth, continuous from in its entirely and also by using a metallic foil having yield strength larger thanthat of both resin layers constituting the multi-layer base.

(3) According to the invention, since the upper cover is made stronger than the lower cover, shock to the can will not cause the upper cover to rupture through the cut.

What is claimed is:

1. A can, comprising:

a barrel;

an upper lid thermally bonded to said barrel; and a lower lid thermally bonded to said barrel;

wherein each of said lids comprises a multi-layer base of a barrier layer impermeable to oxygen and moisture and at least one heat-bondable resin layer formed on one or both side of said barrier layer, and a laminated resin layer laminated to said multi-layer base;

wherein said laminated resin layer of said upper lid comprises an outer planar part, and an inner planar part completely contained within said outer part and separated from said outer party by a belt-shaped gap of said laminated resin layer;

wherein said upper lid further comprises means attached to said inner part of said laminated resin layer thereof having a first part movable outwardly from said barrel relative to said outer part, whereby said multi-layer base of said upper lid is torn inwardly of said barrel in an area of said gap by a second part of said attached means; and wherein a strength of said upper lid is greater than a strength of said lower lid.

2. A can as recited in claim 1, wherein said strengths of said upper and lower lids are respective yield strength limits.

3. A can as recited in claim 2, wherein said respective yield strength limits are fracture points.

4. A can as recited in claim 1, wherein said strengths of said upper and lower lids are respective elastic constants.

5. A can as recited in claim 1, wherein a thickness of said barrier layer of said upper lid is greater than a thickness of said barrier layer of said lower lid.

6. A can as recited in claim 5, wherein said barrier layers comprise metallic foils.

7. A can as recited in claim 1, wherein a thickness of one of said at least one resin layer of said upper lid is greater than a thickness of one of said at least one resin layer of said lower lid.

8. A can as recited in claim 1, wherein said barrier layers of said upper and lower lids are of different materials.

9. A can as recited in claim 1, wherein a yield strength of said barrier layer of said upper lid is greater than that of all of said at least one heat-bondable resin layers of said upper lid.

* * * * *